US011829107B2

(12) United States Patent
Perret et al.

(10) Patent No.: US 11,829,107 B2
(45) Date of Patent: Nov. 28, 2023

(54) MICRO-MECHANICAL TIMEPIECE PART

(71) Applicant: PATEK PHILIPPE SA GENEVE, Geneva (CH)

(72) Inventors: Julien Perret, Andilly (FR); Rémy Fournier, Neuchâtel (CH); Sylvain Jeanneret, Colombier (CH)

(73) Assignee: PATEK PHILIPPE SA GENEVE, Geneva (CH)

( * ) Notice: Subject to any disclaimer, the term of this patent is extended or adjusted under 35 U.S.C. 154(b) by 722 days.

(21) Appl. No.: 16/968,056

(22) PCT Filed: Feb. 4, 2019

(86) PCT No.: PCT/IB2019/050875
§ 371 (c)(1),
(2) Date: Aug. 6, 2020

(87) PCT Pub. No.: WO2019/155347
PCT Pub. Date: Aug. 15, 2019

(65) Prior Publication Data

US 2021/0034015 A1 Feb. 4, 2021

(30) Foreign Application Priority Data

Feb. 7, 2018 (EP) ..... 18155609

(51) Int. Cl.
*G04B 15/14* (2006.01)
*G04B 15/08* (2006.01)
*G04D 3/00* (2006.01)

(52) U.S. Cl.
CPC ..... *G04B 15/14* (2013.01); *G04B 15/08* (2013.01); *G04D 3/0069* (2013.01)

(58) Field of Classification Search
CPC ..... G04B 15/14; G04B 15/08; G04B 31/08; G04D 3/0069; G04D 3/0087; B81C 2201/013; B81C 2201/0132
See application file for complete search history.

(56) References Cited

U.S. PATENT DOCUMENTS 5,501,893 A 3/1996 Laermer et al.
2012/0051192 A1* 3/2012 Steinmuller ..... G04B 13/02 427/249.14
2016/0376147 A1* 12/2016 Gandelhman ..... B81C 1/00103 368/139

FOREIGN PATENT DOCUMENTS

CH 710 846 9/2016
EP 0 732 635 9/1996
(Continued)

OTHER PUBLICATIONS

International Search Report for PCT/IB2019/050875 dated May 23, 2019, 5 pages.

*Primary Examiner* — Edwin A. Leon
*Assistant Examiner* — Kevin Andrew Johnston
(74) *Attorney, Agent, or Firm* — NIXON & VANDERHYE

(57) ABSTRACT

The micromechanical clockwork part is cut from a plate-like silicon substrate. The cut edges of the part include portions intended to serve as contact surfaces arranged to slide against corresponding contact zones of another micromechanical part in a clockwork piece. The cut edges have a ribbed surface including an alternating set of ribs and furrows, the ribs and the furrows being straight and each contained in a plane parallel to the plate. Moreover, the ribs and furrows which the cut edges have form a stepped pattern on the cut edge, with first intervals in which the spacing separating the ribs from one another is equal to a first distance, and at least one second interval in which the
(Continued)

spacing between the ribs is equal to a second distance different from the first distance.

20 Claims, 5 Drawing Sheets

(56) References Cited

FOREIGN PATENT DOCUMENTS

| | | | | | |
|---|---|---|---|---|---|
| EP | 3 109 200 | | | 12/2016 | |
| EP | 3 141 520 | | | 3/2017 | |
| JP | 2011-158050 | A | | 8/2011 | |
| JP | 2011158050 | A | * | 8/2011 | |
| JP | 2017-053855 | A | | 3/2017 | |
| WO | WO-2015125081 | A1 | * | 8/2015 | ..... B81C 99/0095 |

* cited by examiner

MICRO-MECHANICAL TIMEPIECE PART

This application is the U.S. national phase of International Application No. PCT/IB2019/050875 filed Feb. 4, 2019 which designated the U.S. and claims priority to European Application No. 18155609.3 filed Feb. 7, 2018, the entire contents of each of which are hereby incorporated by reference.

The present invention relates, in a first aspect, to a micro-mechanical timepiece part cut out in a plate-shaped silicon substrate and the cut edges of which comprise portions provided to serve as contact surfaces arranged to slide against corresponding contact zones of another micro-mechanical part in a timepiece, the cut edges of the part having a ribbed surface comprising an alternation of ribs and furrows, these ribs and these furrows being straight. This first aspect of the invention relates in particular to a micro-mechanical timepiece part which conforms to the definition given above and is part of a lever escapement.

In a second aspect, the present invention relates to a method of manufacturing a micro-mechanical timepiece part which conforms to the first aspect of the invention, the method comprising the steps of:

- obtaining a silicon substrate in the form of a plate;
- depositing and structuring an openwork etching resist on a horizontal surface of the substrate;
- etching by reactive-ion etching the surface of the substrate through the openings in the resist so as to hollow out the substrate;
- depositing a chemically inert passivation layer on the surfaces exposed by the etching during the preceding step;
- repeating the execution of a sequence of steps formed by the preceding two steps until the sequence has been effected a predetermined first number of times or the reactive-ion etching has hollowed through the entire thickness of the substrate;
- releasing the micro-mechanical part from the resist and from the substrate.

PRIOR ART

The production of micro-mechanical timepiece parts and in particular such parts forming part of a lever escapement by micro-machining of a monocrystalline or polycrystalline silicon wafer is known. EP 0 732 635 in particular describes the production of an escapement lever from silicon. The micro-machining of the silicon consists in large part of etching operations. Etching resists are generally used in order to give the parts the desired shape, these resists having previously been deposited and structured on the horizontal surface of the silicon substrate. The most widely used etching technique is called deep reactive-ion etching, DRIE. U.S. Pat. No. 5,501,893 in the name of Robert Bosch GmbH, in particular, proposes etching profiles with quasi-vertical flanks in a silicon substrate by applying a procedure which alternates the steps of depositing an inert passivation layer and plasma etching. The steps of depositing the passivation layer and the etching steps all make use of fluorine compounds, so that they take place within a single chemical context. Each step lasts a few seconds, the passivation layer is formed over the whole surface of the substrate so that this substrate is protected from any subsequent etching. However, during the following etching step, bombardment by ions which are accelerated vertically causes disintegration of the part of the passivation layer at the bottom of the profiles (but not that which covers the flanks thereof). The bottom of the profiles is thus very quickly exposed to the reactive etching. U.S. Pat. No. 5,501,893 is incorporated by reference.

The sequence formed by an etching step followed by a step of depositing a passivation layer is repeated many times. For example, between 100 and 1000 times in order to etch a groove which passes vertically from one side of a substrate 500 microns thick to the other. The alternating succession of depositing steps and etching steps does not produce perfectly straight flanks but rather flanks which are finely undulating and which have an alternation of regularly spaced reliefs and hollows. The amplitude of the undulation is dependent on the frequency with which the depositing and etching steps alternate.

The manufacture of micro-mechanical timepiece parts by micro-machining of a silicon wafer by DRIE technology gives good results. However, it is not uncommon for the vertical flanks of a micro-mechanical part to be intended to serve as contact surfaces provided to slide against at least one contact zone of another micro-mechanical part. It proves to be the case that these vertical contact surfaces are not entirely satisfactory from a tribological point of view.

A number of ideas have been advanced to attempt to overcome this problem. Firstly, attempts have been made to make the flanks of the micro-mechanical parts as straight as possible by shortening the duration of the individual etching steps. This procedure makes it possible to obtain almost perfectly smooth flanks. However, this is at the cost of a significant reduction in the speed of execution of the etching process. Another solution is described in patent EP 3 109 200. This document actually proposes producing micro-mechanical parts with peripheral walls which sub-divide into two levels. An upper level having a surface which is substantially vertical, and a lower level with a surface orientated obliquely in the manner of chamfer. Since the peripheral wall of the second level is inclined relative to the vertical, it does not come into contact with the contact zone of the other micro-mechanical part. The actual area of contact is thus reduced compared with a part with vertical flanks.

BRIEF DESCRIPTION OF THE INVENTION

One aim of the present invention is to overcome the disadvantages of the prior art which have just been described. The present invention achieves this aim and others by providing a micro-mechanical timepiece part according to claim 1 as attached, and two manufacturing methods according to claims 13 and 14 as attached, respectively.

In accordance with the invention, the ribs and furrows form a spaced-apart pattern with first intervals in which the spacing separating the ribs from each other is equal to a first distance, and at least one second interval in which the spacing between the ribs is equal to a second distance different from the first distance. Tests carried out by the applicant have shown that the presence of a spaced-apart pattern having the above-mentioned features improves tribological properties by reducing friction during contact.

According to certain embodiments of the invention, the ribs and furrows are each contained within a plane parallel to the plate.

According to other embodiments of the invention, the ribs and furrows are perpendicular to the main faces of the plate.

According to a first embodiment of the invention, the furrows belonging to the first intervals are preferably all of the same first depth. This depth is between 10 nm and 2 μm.

According to a second embodiment of the invention, the second distance is preferably greater than the first distance.

According to a third embodiment of the invention, the spaced-apart pattern comprises a plurality of second intervals, and the second distance is between 200 nm and 50 μm, and preferably between 800 nm and 10 μm.

According to an advantageous variant of the third embodiment, the furrows belonging to the second intervals are all of the same depth. This depth is between 10 nm and 10 μm.

According to an advantageous variant of the second embodiment, the spaced-apart pattern comprises a single second interval comprising a single furrow, and the second distance is between 200 nm and ⅔ of the total height of the part, and preferably between ⅓ and ½ the total height of the part. Furthermore, the depth of the single furrow of the second interval is preferably between 10 nm and 50 μm.

BRIEF DESCRIPTION OF THE FIGURES

Other features and advantages of the present invention will become clear upon reading the following description, given solely by way of non-limiting example, and given with reference to the attached drawings in which.

DETAILED DESCRIPTION OF EMBODIMENTS

The invention will be described hereinunder in the context of a Swiss lever escapement. However, it will be understood that the invention is not limited to this restricted area of application but that, on the contrary, it relates to all micro-mechanical timepiece devices in which two components are caused to slide and thus to rub against each other.

Figure 1:
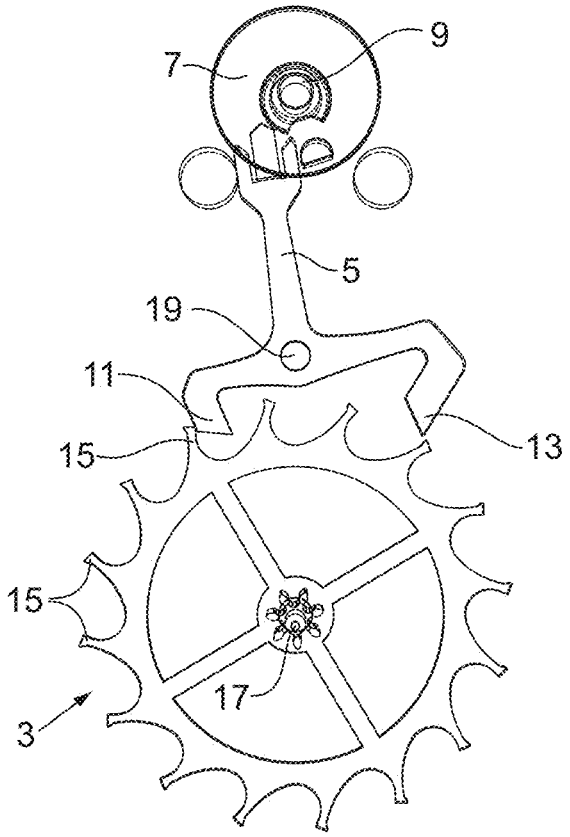
FIG. 1 is a schematic plan view illustrating a Swiss lever escapement of the prior art.

FIG. 1 is a schematic plan view illustrating a Swiss lever escapement of the prior art. The mechanism illustrated comprises in particular an escapement wheel 3, a lever 5 and a roller-table 7, through the centre of which passes the spindle of the balance 9. The two arms of the lever each terminate in a pallet 11, 13. The pallets are arranged to cooperate with the teeth 15 of the escapement wheel 3. The escapement wheel is connected to the barrel (not illustrated) by means of a going train (not illustrated) which comes into engagement with the escapement pinion (referenced 17). The escapement wheel is thus permanently forced forwards (in other words, in the clockwise direction as illustrated in FIG. 1). It will be noted that at the time shown, one of the teeth 15 of the escapement wheel 3 is immobilised against the lock face of the entry pallet 11 of the lever 5. Driven by the balance, the lever 5 begins a pivoting movement about the spindle 19 in the clockwise direction. The pivoting of the lever in the clockwise direction leads to the entry pallet sliding in the upwards direction (in the drawing) against the front flank of the tooth 15. This disengagement phase will terminate at the moment when the lock plane of the pallet has ceased to be an obstacle to the advancing of the front flank of the tooth 15. Then, it will be the flattened tip of this same tooth (named impulse plane of the tooth) which will be caused to slide against the lower face of the pallet 11 (the impulse plane of the pallet). The angled contact between the two impulse planes will also have the effect of repelling the entry pallet 11 upwards so that the pivoting movement of the lever 5 in the clockwise direction will be accentuated. This impulse phase will terminate when the entry pallet 11 has been repelled sufficiently far as to offer a fully free passage to the tooth 15. The two successive phases just described, during which a tooth 15 of the escapement wheel 3 slides against the surfaces of one of the pallets 11, 13 of the lever 5, each generate considerable friction.

Figure 2A:
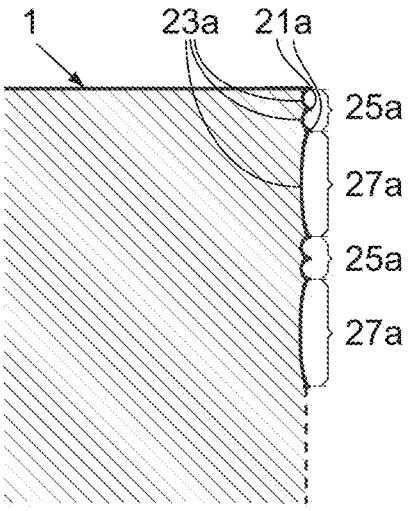
FIGS. 2A, 2B and 2C are schematic cross-sectional views showing the ribbed surfaces on the cut edges of three micro-mechanical timepiece parts which correspond respectively to three variants of a particular first embodiment of the invention.
Figure 2B:
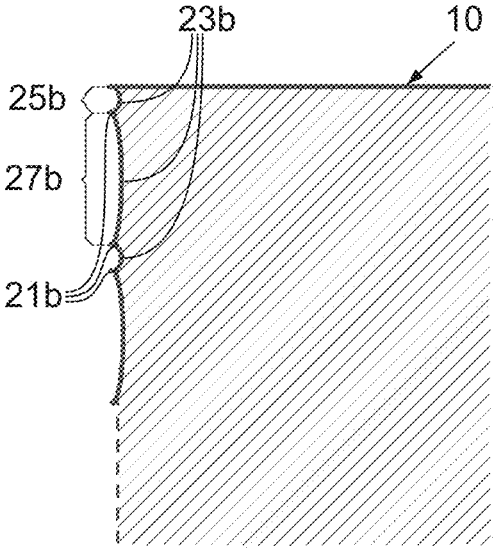
Figure 2C:
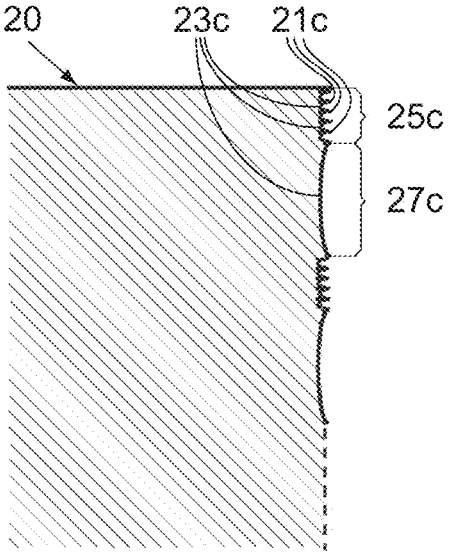

FIGS. 2A, 2B and 2C are schematic cross-sectional views showing the ribbed surfaces on the cut edges of three micro-mechanical timepiece parts 1, 10 and 20 which correspond respectively to three variants of a particular first embodiment of the invention. Referring now more particularly to FIG. 2A, it can be seen that, in accordance with the invention, the ribs 21*a* and the furrows 23*a* on the cut edges of the part 1 form a spaced-apart or staggered pattern with first intervals 25*a* in which the ribs are separated from each other by narrow furrows, the width of which is equal to a first distance, and second intervals 27*a* in which the ribs are separated from each other by a wide furrow, the width of which is equal to a second distance greater than the first distance. Moreover, it can be seen that, in the illustrated embodiment, the first intervals 25*a* and the second intervals 27*a* alternate cyclically so that a second interval is always interposed between two first intervals and vice versa. It will thus be understood that in accordance with what is shown in FIG. 2A, the ribbed surface of the cut edge of the part 1 has a pattern which repeats periodically over the whole height of the part. In the illustrated variant, this pattern is formed by two narrow furrows followed by a single wide furrow. It can also be stated that, in this variant, the narrow furrows can have e.g. a width of 2 μm and a depth between 10 nm and 2 μm. Furthermore, the wide furrows can have a width of 8 μm and a depth between 10 nm and 10 μm.

The pattern on the ribbed surface of the cut edge of the part illustrated in FIG. 2B is quite similar to the pattern in FIG. 2A. In fact, it can be noted that the ribs 21*b* and the furrows 23*b* on the cut edges of the part 10 form a staggered, or in other words, spaced-apart, pattern with first intervals 25*b* in which the furrows 23*b* are narrow, and second intervals 27*b* in which the furrows 23*b* are wide. Furthermore, as was already the case with the example of FIG. 2A, the ribbed surface of the cut edge of the part 10 has a pattern which repeats periodically over the whole height of the part. It can be seen that, in the variant of FIG. 2B, this pattern is formed by a single narrow furrow followed by a wide furrow. It can also be stated that, in this variant, the narrow furrows can have e.g. a width of 1 μm and a depth between 10 nm and 2 μm. Furthermore, the wide furrows can have a width of 9 μm and a depth between 10 nm and 10 μm.

The pattern on the ribbed surface of the cut edge of the part illustrated in FIG. 2C is quite similar to the pattern in FIGS. 2A and 2B. It can be seen that the ribbed surface of the cut edge of the part 20 has a pattern which repeats periodically over the whole height of the part. It can be seen that, in the variant of FIG. 2C, this pattern is formed by five narrow furrows followed by a single wide furrow. It can also be stated that, in this variant, the narrow furrows can have e.g. a width of 1 μm and a depth between 10 nm and 2 μm. Furthermore, the wide furrows can have a width of 9 μm and a depth between 10 nm and 10 μm.

Figure 3:
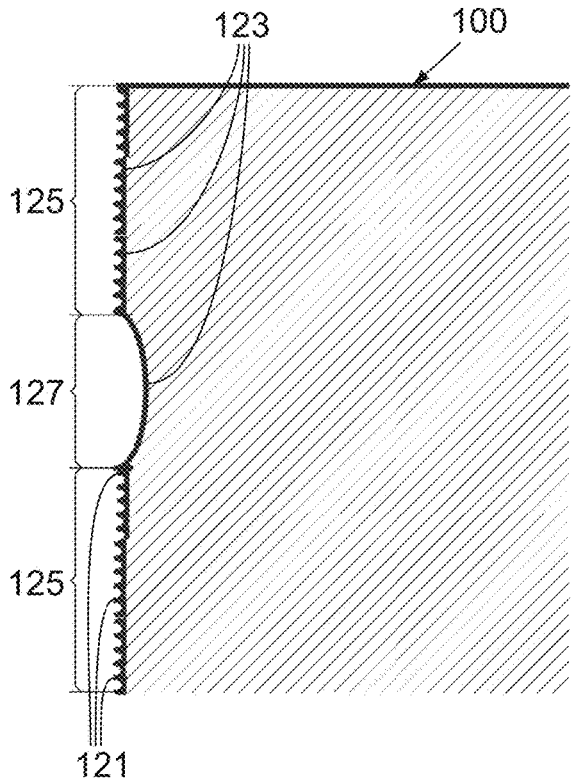
FIG. 3 is a schematic cross-sectional view showing the ribbed surface on the cut edges of a micro-mechanical timepiece part in accordance with a particular second embodiment of the invention.

FIG. 3 is a schematic cross-sectional view showing the ribbed surface on the cut edges of a micro-mechanical timepiece part 100 in accordance with a particular second embodiment of the invention. It can be seen in FIG. 3 that the ribs 121 and the furrows 123 on the cut edge of the part 100 form a staggered or spaced-apart pattern with first intervals 125 in which the spacing separating the ribs 121 from each other is equal to a first distance, and a second interval 127 in which the spacing between the ribs is equal to a second distance different from the first distance. In the embodiment illustrated, the single second interval 127 is itself formed by a single furrow 123, the width of which is equal to said second distance. It can be seen that, in the illustrated embodiment, this second distance is greater than a quarter of the total thickness of the part 100. By way of example, the part 100 could have a thickness between 80 μm and 500 μm, and said second distance could be between 20 μm and 150 μm. Still with reference to FIG. 3, it can also be seen that, in the illustrated embodiment, there are two first intervals 125. The two intervals 125 each extend between one of the two main surfaces of the part 100 and the second interval 127. It can also be seen that, in the illustrated example, the two intervals 125 have the same number of furrows 123 and that they are thus of the same width. However, it will be understood that, according to other variants of the present embodiment, the two intervals 125 could have different numbers of furrows. It can also be stated that, in the illustrated embodiment, the furrows which form the first intervals 125 are narrow furrows which can have e.g. a width of 1 μm and a depth between 10 nm and 2 μm.

The present invention also relates to a method permitting manufacture of micro-mechanical timepiece parts such as those illustrated in the appended FIGS. 2A, 2B, 2C and 3. A particular manner of implementing the method of the invention will now be described.

The method of the invention comprises a first step consisting of obtaining a silicon substrate in the form of a plate. Of course, it would be possible for the substrate not to be entirely formed of silicon or even to be formed of doped silicon. The substrate could be formed of silicon on insulator (SOI). As a person skilled in the art will know, such a substrate with a sandwich structure comprises two layers of silicon connected by an intermediate layer of silicon dioxide. The substrate could alternatively be formed of a layer of silicon attached to another type of base such as e.g. metal.

The following step of the method consists of depositing and structuring an openwork etching resist on a horizontal surface of the substrate. The etching resist is formed on one of the two main faces of the substrate in the form of a plate. Reference to FIGS. 2A, 2B, 2C and 3 will reveal that, in the illustrated examples, the etching resist is formed on the upper horizontal face of the substrate. The resist is formed from a material able to resist the subsequent etching steps. In accordance with the present example, the etching resist is produced from silicon dioxide.

The method continues by means of a step consisting of etching by reactive-ion etching the exposed surface of the substrate through the openings in the resist so as to hollow out the substrate to a depth equal to a first distance. Reactive-ion etching is known per se to a person skilled in the art. The gas most commonly used for the etching step is SF6, and the main parameters permitting optimisation of the etching are the flow of SF6 which is advantageously between 200 and 780 sccm, preferably between 350 and 600 sccm; the radio frequency power serving to excite the plasma which is advantageously between 1000 and 3000 Watts at 2.45 GHz, and preferably between 1500 and 2600 Watts at 2.45 GHz; and the duration of an etching step which is advantageously between 0.8 seconds and 35 seconds and preferably between 1.5 and 7 seconds. The parameters are selected so that, at the end of the step, the ion etching has hollowed out the silicon substrate to a depth equal to a predefined first distance (e.g. 2 microns in the case of the example of FIG. 2A).

The following step of the method consists of depositing a chemically inert passivation layer on the surfaces exposed by the etching during the preceding step. The gas most commonly used for the passivation step is C4F8, and the main parameters permitting optimisation of the deposition of the passivation layer are the flow of C4F8 which is advantageously between 10 and 780 sccm, preferably between 50 and 400 sccm; the radio frequency power serving to excite the plasma which is advantageously between 1000 and 3000 Watts at 2.45 GHz, and preferably between 1500 and 2600 Watts at 2.45 GHz; and the duration of a passivation step which is advantageously between 0.8 seconds and 20 seconds and preferably between 1 and 4 seconds.

The method sequence comprising the etching step and the passivation step just described is then repeated. This first iterative sequence is executed consecutively a predetermined first number (n) of times, or in an equivalent manner, the first iterative sequence is carried out as many times as there are furrows in a first interval (in other words, twice in the example shown in FIG. 2A, once according to FIG. 2B and 5 times according to FIG. 2C).

In order to etch deeper furrows while retaining the same furrow width it is possible to adapt the parameters of the etching process. For example, it is possible to vary the flow of reactive gas and the duration of an etching step simultaneously. In fact, by increasing the flow of active gas, the etching is accelerated. However, this also increases the density of the molecules of reactive gas, which renders the etching more isotropic, and thus makes the furrows deeper. In order to influence the depth of the furrows, the gas flow factor is thus more important than the duration of the etching step.

When the method has terminated the etching of a first interval as above, the following step of the method consists of etching by reactive-ion etching the exposed surface of the substrate through the openings in the resist so as to hollow out the substrate to a depth equal to a second distance different from the first distance. The etching parameters are selected so that, at the end of the step, the ion etching has hollowed out the silicon substrate to a depth equal to a predefined second distance (e.g. 8 microns in the case of the example of FIG. 2A). The following step of the method consists of depositing a chemically inert passivation layer on the surfaces exposed by the etching during the preceding step.

The sequence of the method comprising the etching step and the passivation step just described is then repeated. This second iterative sequence is executed consecutively a predetermined second number (m) of times, or in an equivalent manner, the second iterative sequence is carried out as many times as there are furrows in a second interval (in other words, once in each of the examples illustrated in FIGS. 2A, 2B, 2C and 3). When the method has terminated the etching of a second interval as above, the method proceeds by returning to the start of the first iterative sequence so as to begin etching a new first interval.

The method sequence consisting of first etching a first interval and then a second interval can itself be repeated. This third iterative sequence is executed a specific third number (v) of times, or in an equivalent manner, the third iterative sequence is carried out once for each second interval on the ribbed surface of the cut edge of the part.

The micro-mechanical timepiece part is then freed of its resist before, preferably, being covered with a silicon dioxide layer before it is finally released from the substrate.

Figure 4:
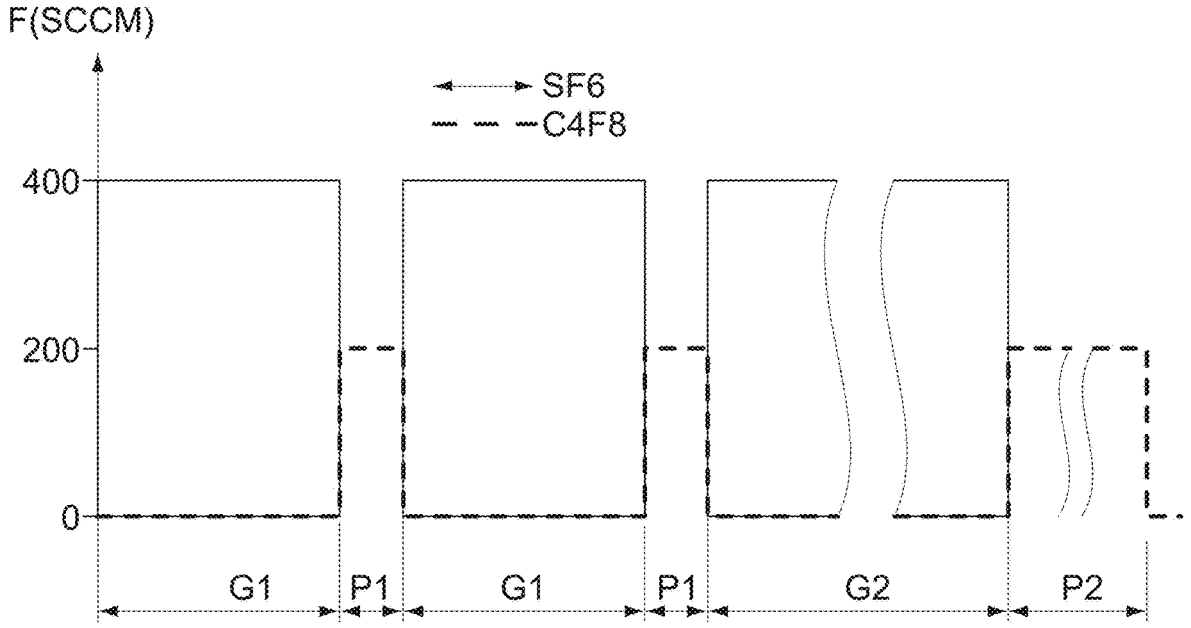
FIG. 4 is a double graph showing the evolution of the flow of reactive gas and the flow of passivation gas during six consecutive steps of one particular implementation of one of the two methods of the invention.

FIG. 4 is a double graph showing the evolution of the flow of the reactive gas and the flow of passivation gas during six consecutive steps of one particular implementation of the method of the invention used to produce the micro-mechanical timepiece parts shown in FIGS. 2A, 2B, 2C and 3. More specifically, the manner of implementation of FIG. 4 makes it possible to produce the micro-mechanical part of the example of FIG. 2A. The graph shows a first iterative sequence comprising an etching step G1 followed by a passivation step P1. During the etching step, the flow of SF6 is 400 sccm over 5 seconds. During the passivation step, the flow of C4F8 is 200 sccm over 2 seconds. As can be seen, the first iterative sequence is then repeated once so as to complete a first interval formed of two furrows. Once the first interval is completed, the method passes to a second sequence formed by an etching step G2 followed by a passivation step P2. During the etching step G2, the flow of SF6 is 400 sccm over 35 seconds. During the passivation step P2, the flow of C4F8 is 200 sccm over 15 seconds.

Figure 5:
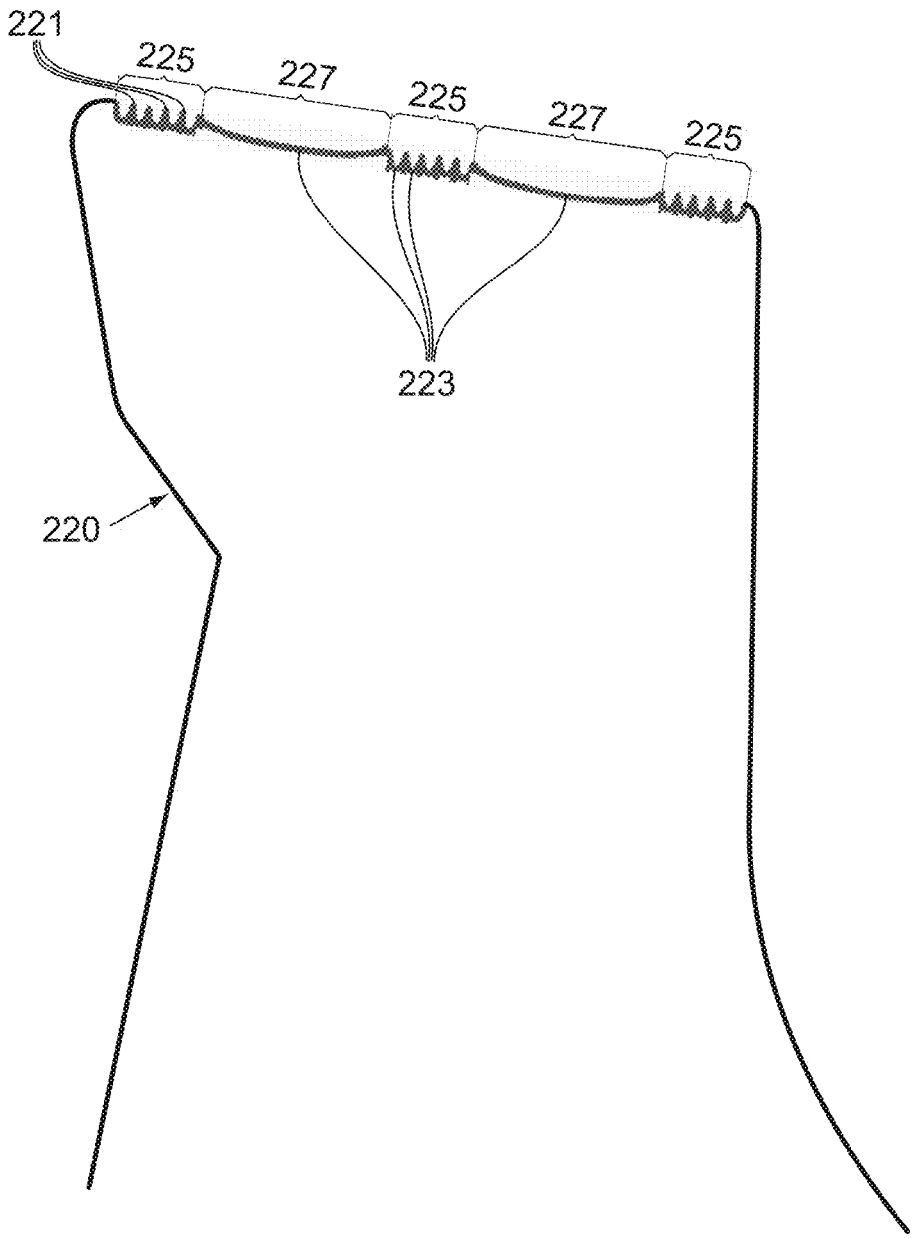
FIG. 5 is a schematic plan view of a tooth of an escapement wheel according to a third embodiment of the invention, the formed ribs and furrows on the impulse plane of the tooth being perpendicular to the main plane of the escapement wheel.
Figure 6:
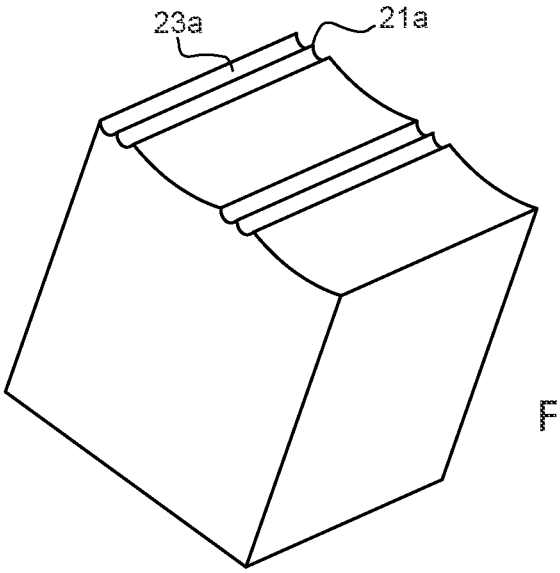
FIG. 6 is a perspective view of the micro-mechanical timepiece part shown in FIG. 2A.
Figure 7:
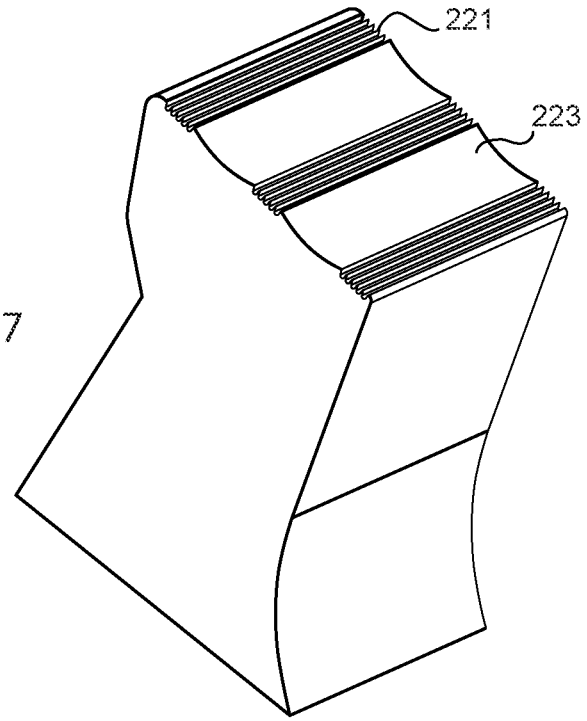
FIG. 7 is a perspective view of the escapement-wheel tooth shown in FIG. 5.

It has been shown that, in accordance with the invention, the surface of the cut edges of the micro-mechanical timepiece part is ribbed and comprises an alternation of straight ribs and furrows. According to both embodiments described thus far, these ribs and these furrows were horizontal or, in other words, each contained within a plane parallel to the plate. The partial schematic plan view of FIG. 5 illustrates a third exemplified embodiment of the invention, the micro-mechanical part being formed by an escapement wheel. In accordance with this embodiment, the ribs and the furrows are orientated perpendicularly to the main plane of the escapement wheel. The partial view of FIG. 5 shows only a single one of the teeth (referenced 200) of the escapement wheel. As shown in the figure, the impulse plane of the tooth 200 has an alternation of ribs 221 and furrows 223 which are straight and vertical. It can be noted that the ribs 221 and the furrows 223 form a spaced-apart pattern, with first intervals 225 in which the furrows 223 are narrow, and second intervals 227 in which the furrows are wide. Moreover, the ribs 221 and the furrows 223 have a pattern which repeats periodically over the whole width of the impulse plane of the tooth 200.

In order to produce a batch of micro-mechanical timepiece parts which conform to the invention and comprise vertically textured surfaces it is possible to use a method of manufacturing a micro-mechanical part of mono-crystalline or poly-crystalline silicon comprising the following steps:

a) obtaining a silicon substrate;

b) depositing and structuring an openwork etching resist on a horizontal surface of the substrate;

c) etching by reactive-ion etching the surface of the substrate through the openings in the resist so as to hollow out the substrate down to a first distance;

d) depositing a chemically inert passivation layer on the surfaces exposed by the etching during the preceding step;

e) repeating the execution of a sequence of steps comprising step (c) followed by step (d) until the sequence has been effected a specific number of times or the reactive-ion etching has hollowed through the entire thickness of the substrate;

f) releasing the micro-mechanical part from the resist and from the substrate;

characterised in that, during step (b), the etching resist is structured so that the edges of the openings in the openwork resist are not smooth but, on the contrary, have a scalloped profile formed by an alternation of projections and hollows which form a spaced-apart pattern with a plurality of first intervals in which the spacing separating the projections from each other is equal to a first distance, and second intervals in which the spacing between the projections is equal to a second distance different from the first distance, the first distance being between 200 nm and 5 μm, and preferably between 200 nm and 2 μm.

It will also be understood that various modifications and/or improvements obvious to a person skilled in the art can be made to the embodiments being described in the present description without departing from the scope of the present invention defined by the accompanying claims. In particular, although the invention has been described in relation to an escapement wheel and a lever it is clear that the invention does not relate only to the components of escapements but that it relates in a completely general way to all micro-mechanical timepiece parts.

The invention claimed is:

1. Micro-mechanical timepiece part (1; 10; 20; 100; 200) cut out in a silicon substrate in the form of a plate and the cut edges of which comprise portions provided to serve as contact surfaces arranged to slide against corresponding contact zones of another micro-mechanical part in a timepiece, and wherein the cut edges have a ribbed surface comprising an alternation of ribs (21*a*; 21*b*; 21*c*; 121; 221) and furrows (23*a*; 23*b*; 23*c*; 123; 223), the ribs and the furrows being straight; wherein the ribs and the furrows form a spaced-apart pattern, comprising a plurality of first intervals (25*a*; 25*b*; 25*c*; 125; 225) in which the spacing separating the ribs from each other is equal to a first distance, and at least one second interval (27*a*; 27*b*; 27*c*; 127; 227) in which the spacing between the ribs is equal to a second distance different from the first distance, the first distance being between 200 nm and 5 μm.

2. The micro-mechanical timepiece part (1; 10; 20; 100; 200) as claimed in claim 1, wherein the first distance is between 200 nm and 2 μm.

3. The micro-mechanical timepiece part (1; 10; 20; 100) as claimed in claim 1, wherein the ribs and the furrows are each contained within a plane parallel to the plate.

4. The micro-mechanical timepiece part (200) as claimed in claim 1, wherein the ribs and the furrows are perpendicular to the main faces of the plate.

5. The micro-mechanical timepiece part (1; 10; 20; 100; 200) as claimed in claim 1, any one of the preceding claims, wherein the second distance is greater than the first distance.

6. The micro-mechanical timepiece part (1; 10; 20; 100; 200) as claimed in claim 3, wherein the furrows belonging to the first intervals (25*a*, 25*b*, 25*c*; 125; 225) are all of the same depth.

7. The micro-mechanical timepiece part (1; 10; 20; 200) as claimed in claim 5, wherein the spaced-apart pattern comprises a plurality of second intervals (27*a*; 27*b*; 27*c*; 227), and wherein in that the second distance is between 200 nm and 50 μm.

8. The micro-mechanical timepiece part (1; 10; 20; 200) as claimed in claim 7, wherein the furrows belonging to the second intervals (27*a*; 27*b*; 27*c*; 227) are all of the same depth, and wherein in that the second depth is between 10 nm and 10 μm.

9. The micro-mechanical timepiece part (100) as claimed in claim 5, wherein the spaced-apart pattern comprises a single second interval (127) comprising a single furrow (123), and wherein the second distance is between 200 nm and ⅔ of the total height of the part.

10. The micro-mechanical timepiece part (100) as claimed in claim 9, wherein the depth of the single furrow (123) of the second interval (127) is between 10 nm and 50 μm.

11. The micro-mechanical timepiece part (1; 10; 20; 100) as claimed in claim 6, wherein the first depth is between 10 nm and 2 μm.

12. The micro-mechanical timepiece part (200) as claimed in claim 4, wherein the furrows belonging to the first intervals (25*a*, 25*b*, 25*c*; 125; 225) are all of the same depth, and characterised in that the first depth is between 500 nm and 4 μm.

13. Method of manufacturing a micro-mechanical part of monocrystalline or polycrystalline silicon and which is as claimed in claim 3, the method comprising the following steps:

a) obtaining a silicon substrate;

b) depositing and structuring an openwork etching resist on a horizontal surface of the substrate;

c) etching by reactive-ion etching the surface of the substrate through the openings in the resist so as to hollow out the substrate down to a first distance;

d) depositing a chemically inert passivation layer on the surfaces exposed by the etching during the preceding step;

e) repeating the execution of a first sequence of steps comprising step (c) followed by step (d) until the first sequence has been effected a predetermined first number (n) of times, in as far as the reactive-ion etching has not hollowed through the entire thickness of the substrate;

f) releasing the micro-mechanical part from the resist and from the substrate; wherein between step e) and step f), the method comprises a second sequence of steps to be effected only if step e) has not yet been effected a specific third number (v) of times during the execution of the method, the second sequence comprising the following steps:

x) etching by reactive-ion etching the surface of the substrate through the openings in the resist so as to hollow out the substrate down to a second distance different from the first distance;

y) depositing a chemically inert passivation layer on the surfaces exposed by the etching during the preceding step;

z) repeating the execution of a second sequence of steps comprising step x) followed by step y) until the second sequence has been effected a predetermined second number (m) of times; then returning to step c).

14. Method of manufacturing a micro-mechanical part of monocrystalline or polycrystalline silicon and which is as claimed in claim 4, the method comprising the following steps:

a) obtaining a silicon substrate;

b) depositing and structuring an openwork etching resist on a horizontal surface of the substrate;

c) etching by reactive-ion etching the surface of the substrate through the openings in the resist so as to hollow out the substrate down to a first distance;

d) depositing a chemically inert passivation layer on the surfaces exposed by the etching during the preceding step;

e) repeating the execution of a sequence of steps comprising step (c) followed by step (d) until the sequence has been effected a specific number of times or the reactive-ion etching has hollowed through the entire thickness of the substrate;

f) releasing the micro-mechanical part from the resist and from the substrate; wherein, during step (b), the etching resist is structured so that the edges of the openings in the openwork resist are not smooth but, on the contrary, have a scalloped profile formed by an alternation of projections and hollows which form a spaced-apart pattern with a plurality of first intervals in which the spacing separating the projections from each other is equal to a first distance, and at least one second interval in which the spacing between the projections is equal to a second distance different from the first distance, the first distance being between 500 nm and 4 μm.

15. The method manufacturing a micro-mechanical part as claimed in claim 14, wherein the first distance is between 200 nm and 2 μm.

16. The micro-mechanical timepiece part (1; 10; 20; 100) as claimed in claim 2, wherein the ribs and the furrows are each contained within a plane parallel to the plate.

17. The micro-mechanical timepiece part (200) as claimed in claim 2, wherein the ribs and the furrows are perpendicular to the main faces of the plate.

18. The micro-mechanical timepiece part (1; 10; 20; 100; 200) as claimed in claim 2, wherein the second distance is greater than the first distance.

19. The micro-mechanical timepiece part (1; 10; 20; 100; 200) as claimed in claim 3, wherein the second distance is greater than the first distance.

20. The micro-mechanical timepiece part (1; 10; 20; 100; 200) as claimed in claim 4, wherein the second distance is greater than the first distance.

* * * * *